United States Patent [19]

Hamlyn

[11] 4,349,501

[45] * Sep. 14, 1982

[54] CONTINUOUS SPIN-DRAW POLYESTER PROCESS

[75] Inventor: Maxwell C. Hamlyn, Cary, N.C.

[73] Assignee: Allied Chemical Corporation, Morris Township, Morris County, N.J.

[ * ] Notice: The portion of the term of this patent subsequent to Feb. 17, 1998, has been disclaimed.

[21] Appl. No.: 232,448

[22] Filed: Feb. 6, 1981

Related U.S. Application Data

[63] Continuation-in-part of Ser. No. 42,188, May 24, 1979, Pat. No. 4,251,481.

[51] Int. Cl.[3] ..... D01D 5/16

[52] U.S. Cl. ..... 264/210.3; 264/210.8; 264/289.6; 264/342 RE

[58] Field of Search ..... 214/210.3, 210.8, 342 RE

[56] References Cited

U.S. PATENT DOCUMENTS 4,251,481 2/1981 Hamlyn ..... 264/210.3

FOREIGN PATENT DOCUMENTS 1395810 5/1975 United Kingdom .
1407111 9/1975 United Kingdom .

*Primary Examiner*—Jay H. Woo
*Attorney, Agent, or Firm*—Virginia S. Andrews

[57] ABSTRACT

A low shrinkage, dimensionally stable, polyester fiber is produced by a process which involves conditions of continuously spinning and drawing filaments wherein the filaments are passed through a steam impinging draw point localizing jet (25) at a temperature of about 482° C. to 580° C. to thereby heat the filaments substantially immediately above their second order transition temperature. The low shrinkage polyester fibers are particularly useful in the preparation of tires and industrial products, including industrial belts, conveyor belts, and reinforced elastomeric structures.

18 Claims, 2 Drawing Figures

CONTINUOUS SPIN-DRAW POLYESTER PROCESS

This is a continuation-in-part of application Ser. No. 42,188, filed May 24, 1979, now U.S. Pat. No. 4,251,481.

BACKGROUND OF THE INVENTION

1. Field of the Invention

This invention relates to the simultaneous (coupled) spin-drawing of continuous filament synthetic fibers from polyester polymer. More particularly, it relates to an improved process for the production of low shrinkage, continuous polyester fibers which are particularly useful in the preparation of tires and industrial products, including industrial belts, conveyor belts, and reinforced elastomeric structures. Still more particularly, it relates to a continuous process for the production of low shrinkage continuous polyester fibers by melt-spinning the polymer followed immediately by drawing the spun fibers wherein the spun fibers are heated substantially immediately above their second order transition temperature by being passed through a steam impinging draw point localizing jet at a steam temperature of 482° C. to 580° C. Yarn thermal shrinkage is reduced and yarn dimensional stability improved with no adverse yarn property changes such as lower strength or higher elongation at break.

2. Description of the Prior Art

There are several prior art processes for reducing thermal shrinkage of polyester yarns; however, this reduction in polyester yarn thermal shrinkage normally can be achieved only by sacrificing strength or mechanical quality, increasing ultimate elongation or elongation at break, or by the expensive alternative of a separate operation following drawing, such as annealing or some other form of heat treatment. It is therefore desirable to have a continuous process which reduces yarn shrinkage without any of the aforementioned disadvantages. In this regard, several processes are known which involve conditions of continuously spinning and drawing filaments.

SUMMARY OF THE INVENTION

The present invention relates to a process for the simultaneous spin-drawing of one or more ends of multifilament, continuous filament, synthetic polyester fiber. This process in addition to reducing percent thermal shrink, produces a dimensionally stable polyester fiber. The process comprises the steps of:

(a) supplying a melt of polyester polymer to a spinning unit;

(b) extruding the melt through a spinnerette having a plurality of extrusion orifices to form filaments;

(c) advancing the extruded filaments through a substantially stationary column of air contained in a heated sleeve having a temperature of about 200° C. to 450° C.;

(d) advancing the filaments through a quenching zone;

(e) lubricating the filaments;

(f) passing the lubricated filaments over a forwarding roll system maintained at a temperature of less than 50° C.;

(g) subsequently passing the filaments through a steam impinging draw point localizing jet at a steam temperature of about 482° C. to 580° C. to heat the filaments substantially immediately above their second order transition temperature;

(h) passing the filaments over a pair of draw rolls wherein at least one of the draw rolls is maintained at a temperature of between about 170° C. and 237° C.;

(i) passing the filaments over a relax roll system maintained at a temperature of about 60° C. to 230° C., yarn tension to the relax roll system being maintained at about 0.2 to 2.0 grams per denier; and (j) winding up the filaments at a tension of from about 0.06 to 1.0 gram per denier.

It is preferred that the melt have an intrinsic viscosity of about 0.60 to 0.96, more preferably of about 0.68 to 0.78, that it be supplied at a temperature of about 272° C. to 320° C. and at a rate of about 15 to 120 (6.8 to 54.4), more preferably 35 to 75 (15.9 to 34.0), pounds per hour (kg per hour) per end. The more preferred temperature of the heated sleeve is about 200° C. to 350° C., most preferably 270° C. to 280° C. It is also preferred that the steam temperature for localizing the draw point of the fiber be about 510° C. to 580° C., most preferably about 550° C.

Throughout the present specification and claims, the intrinsic viscosity of the polyester melt is given as a measure for the mean molecular weight, which is determined by standard procedures wherein the concentration of the measuring solution amounts to 0.5 g./100 ml., the solvent is a 60 percent phenol/40 percent tetrachloroethane mixture, and the measuring temperature is 25° C.

The tenacity or breaking strength in grams per denier (UTS) is defined by ASTM Standards, Part 24, American Society for Testing and Materials 1916 Race Street, Philadelphia, Pa., page 33 (1965) as "the maximum resultant internal force that resists rupture in a tension test, " or "breaking load or force, expressed in units of weight required to break or rupture a specimen in a tensile test made according to specified standard procedures." By "% U.E." is meant elongation at break in percent.

The term shrinkage is defined as "percent decrease in length of a material when exposed to elevated temperatures for a specified period of time and under 0.05 g.p.d. tension." In the present invention the percent thermal shrinkage (% T.S.) is measured between two metal plates maintained at 177° C. for a time period of 60 seconds.

The term "modulus" in grams per denier, also known as tensile modulus (Young's Modulus), is expressed as the ratio of change in stress to change in strain in the initial straight-line portion of the stress-strain curve extrapolated at 100 percent sample elongation.

The term "toughness," also known as toughness index, is defined (above reference) as "the actual work per unit volume (or per unit mass) of material which is required to rupturre the material. It is proportional to the area under the load-elongation curve from the origin to the breaking point." The toughness index is routinely measured in grams centimeter per denier centimeter.

In measuring yarn quality, the mechanical quality rating is made by visual examination of a stationary package wherein a rating of 1 to 3 is assigned with 1 being excellent and 3 being substandard. A strobe examination is made by flashing a strobe on a rotating package wherein the strobe frequency is identical to the RPMs of the package and wherein a visual rating of 1 to 4 is assigned with 1 being excellent and 4 being unacceptable.

The preferred polyesters are the linear terephthalate polyesters, i.e., polyesters of a glycol containing from 2 to 20 carbon atoms and a dicarboxylic acid component containing at least about 75 percent terephthalic acid. The remainder, if any, of the dicarboxylic acid component may be any suitable dicarboxylic acid such as sebacic acid, adipic acid, isophthalic acid, sulfonyl-4,4'-dibenzoic acid, or 2,8-dibenzofuran-dicarboxylic acid. The glycols may contain more than two carbon atoms in the chain, e.g., diethylene glycol, butylene glycol, decamethylene glycol, and bis-(1,4-(hydroxymethyl)cyclohexane. Examples of linear terephthalate polyesters which may be employed include poly(ethylene terephthalate), poly(ethylene terephthalate/5-chloroisophthalate) (85/15), poly(ethylene terephthalate/5-[sodium sulfo]-isophthalate) (97/3), poly(cyclohexane-1,4-dimethylene terephthalate), and poly(cyclohexane-1,4-dimethylene terephthalate/hexahydroterephthalate) (75/25).

DESCRIPTION OF THE PREFERRED EMBODIMENT

It has now been found that reduced shrinkage tire and industrial fiber can be melt-spun continuously from a polyester polymer, e.g., polyethylene terephthalate, and that this fiber can be continuously drawn without the intermediate step of winding up. These results are achieved in accordance with this invention by increasing the steam drawing temperature to enhance crystalline development, thereby enabling economic one-step (coupled) production of fibers with improved dimensional stability (% U.E.+% T.S.) and higher strength (U.T.S.). By "one-step production" is meant that there is no winding up step between the melt spinning and drawing steps, and there is no need for a separate operation or step such as annealing, carried out subsequent to the simultaneous spin-drawing process.

Figure 1:
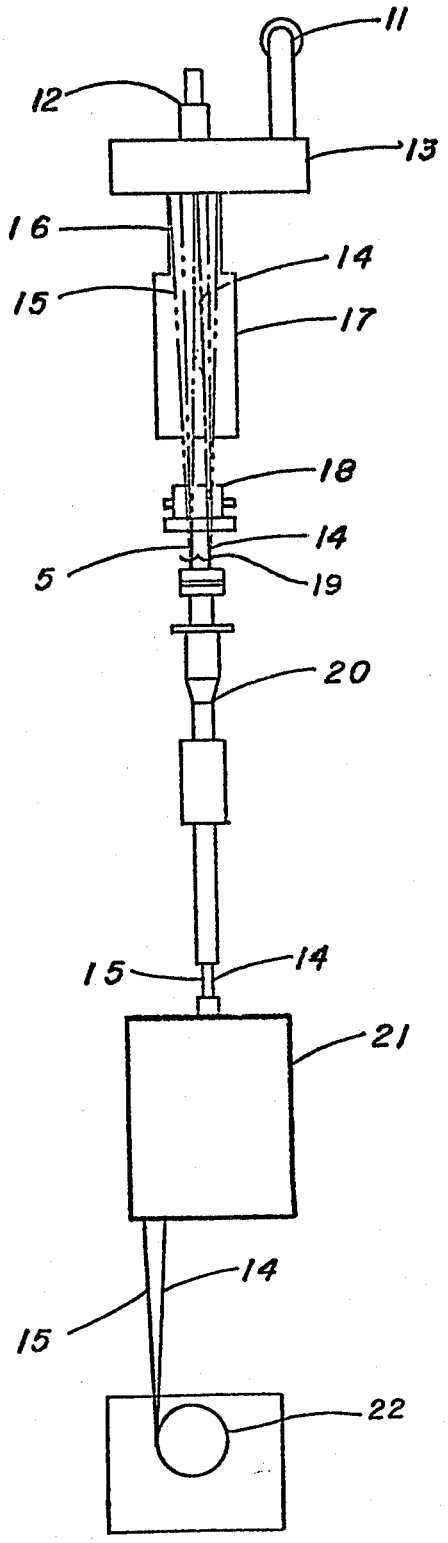
FIG. 1 is a schematic front view of the apparatus used for the method of this invention.
Figure 2:
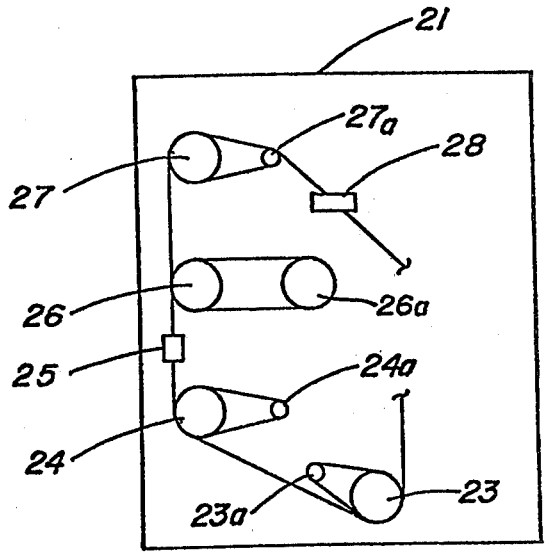
FIG. 2 is a schematic of the draw panel designated by the numeral 21 in FIG. 1.

Referring to FIGS. 1 and 2, like numbers indicate like apparatus. Molten polymer is fed by extruder 11 to spin pump 12 which feeds spin block 13 containing a conventional spin pot, not shown, including a spinnerette and a spinning filter disposed between the spin pump and spinnerette. The spinnerette may be designed for the extrusion of one or more ends of filaments. FIG. 1 illustrates the simultaneous extrusion of two ends 14 and 15 of multifilament, continuous filament yarn from one spinnerette. Ends 14 and 15 are extruded from the spinnerette at a rate of about 15 to 120 (6.8 to 54.4), more preferably 35 to 75 (15.9 to 34.0), pounds per hour (kg per hour) per end, and are passed downwardly from the spinnerette into a substantially stationary column of air contained in a heated sleeve 16 of conventional height, most preferably about 15 inches (38.1 cm). The extrusion rate, of course, will differ depending on the denier and number of ends of yarn being extruded. For instance, a single continuous end of 1000 denier would be extruded from the spinnerette at a rate of about 35 to 50 pounds per hour (15.9 to 22.7 kg per hour), most preferably 40 pounds per hour (18.1 kg per hour), while three continuous ends would be extruded from the spinnerette at a rate of about 90 to 150 pounds per hour (40.8 to 68.0 kg per hour), most preferably at a rate of 120 pounds per hour (54.4 kg per hour). Yarn leaving heated sleeve 16 is passed directly into the top of the quench chamber of conventional quenching apparatus 17. The quench chamber is an elongated chimney of conventional length, preferably from 60 to 80 inches (1.5 to 2.0 m). Ends 14 and 15 of yarn are lubricated by finish applicator 18 and then the ends are separated and the filaments in each end converged by guides 19. A conventional spinning finish composition is used to lubricate the filaments. Finish applicator 18 is depicted as a lube roll which may be rotated either with or against the direction of the yarn movement; it is preferred that the lube roll rotate with the direction of yarn movement. Rotation of the lube roll is at a rate of about 1.5 to 5 revolutions per minute, typically 3.1 revolutions per minute, for a lube roll having a diameter of about 3 to 8 inches (7.62 to 20.3 cm), typically 6 inches (15.2 cm). It is preferred that the filaments be coated with from about 0.2 to about 1.0 weight percent based on the weight of the yarn of the finish, most preferably 0.5 percent. Ends 14 and 15 are then transported via interfloor tube and aspirator 20 to spin draw panel 21 (see FIG. 2) where they are fed to wrap around pretension roll 23 and accompanying separator roll **23*a* and then feed roll 24 and accompanying separator roll 24*a*. From feed roll 224, the ends are then passed through conventional steam impinging draw point localizing jet 25, supplying steam at a temperature of about 482° C. to 580° C., and at a pressure of about 75 to 125 psig (5.27 to 8.79 kg per $cm^2$), and then to a pair of draw rolls 26 and 26*a*. The ends pass from draw rolls 26 and 26*a* to relax roll 27 and accompanying separator roll 27*a*. The yarn ends then pass through a conventional air operated interlacing jet 28 and are taken up by winder 22**.

With respect to the temperatures at which draw rolls 26 and **26*a* are maintained, the ultimate objective is to obtain a yarn temperature of about 190° C. to 220° C. for a given yarn residence time of about 0.25 to 0.5 second, most preferably about 0.4 second. It is believed that the best mode of achieving this objective is by maintaining both of draw rolls 26 and 26*a* at a temperature of about 225° C. to 230° C. This, however, should not be construed as discounting other acceptable draw roll temperatures such as dual rolls at a temperature of about 190° C. to 215° C., or a single roll, preferably roll 26*a***, at about 225° C. to 230° C. In any event, it has been found that at draw roll temperatures of greater than 237° C. the yarn starts sticking to the rolls, and at draw roll temperatures of less than 190° C., there is an undesirable increase in % U.E.+% T.S.

The tension at which the filaments are wound, and thus the temperature at which the relax roll system is maintained, is dependent upon the type of winder utilized. For a manual doff winder with winding tensions of about 0.06 to 0.6 gram per denier, relax roll 27 is maintained at the minimum temperature necessary to maintain temperaturee equilibrium during processing, preferably 60° C. to 120° C. For winders with winding tensions of about 0.1 to 1.0 gram per denier, e.g., some automatic doff winders, relax roll 27 is maintained at the minimum temperature necessary to maintain acceptable high levels of transfer efficiency, up to 230° C., most preferably 120° C. to 175° C. Therefore, the relax roll system should be maintained at a temperature of about 60° C. to 230° C. and winding tension at about 0.06 to 1.0 gram per denier.

In order to demonstrate the invention, the following examples are given. They are provided for illustrative purposes only and are not to be construed as limiting the scope of the invention, which is defined by the appended claims. In these examples parts and percentages are by weight unless otherwise indicated.

EXAMPLE 1

A melt of polyethylene terephthalate having an intrinsic viscosity of about 0.87 to 0.96 was supplied at a rate of 37.5 pounds per hour (17.0 kg per hour) per end and at a temperature of about 300° C. to the apparatus shown in FIGS. 1 and 2. The molten polymer was fed by extruder 11 to spin pump 12 which fed spin block 13 containing a conventional spin pot as shown in FIG. 1 of U.S. Pat. No. 4,072,457 to Cooksey et al., hereby incorporated by reference. The pressure drop through the filter assembly of the spin pot averaged 200 to 400 atmospheres. A split spinnerette designed for the simultaneous extrusion of two multifilament ends of 192 filaments each was utilized, the spinnerette orifices having a diameter of about 0.021 inch (0.05 cm) and being spaced so that the distance between the filaments formed per end was about 0.28 to 0.40 inch (0.71 to 1.0 cm) immediately below the spinnerette.

The two ends 14 and 15 of multifilament, continuous filament yarn passed downwardly from the spinnerette into a substantially stationary column of air contained in a heated sleeve 16, about 15 inches (38.1 cm) in height, the temperature of the sleeve itself being maintained at about 400° C. Yarn leaving heated sleeve 16 was passed directly into the top of the quench chamber of quenching apparatus 17. Quenching apparatus 17 was as shown in FIG. 1C of U.S. Pat. No. 3,999,910 to Pendlebury et al., hereby incorporated by reference. Quenching air at about 65° F. (about 18.33° C.) and 60 percent relative humidity was supplied at about 400 SCFM to cross flow quench the filaments as they descended through the quench chamber, which had a length of about 68.5 inches (1.7 m). The ends 14 and 15 of yarn were lubricated by finish applicator 18 and then separated and converged by guides 19. The spin finish applied consisted of 15 parts of a stearic acid ester of a mixture of secondary alcohols having the general structure

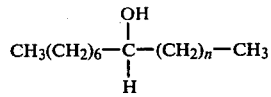

where n is 5 to 6, 15 parts refined coconut oil, 13 parts of ethoxylated lauryl alcohol, 2 parts of dinonyl-sodium-sulfosuccinate, 5 parts ethoxylated tallow amine, 10 parts of sodium salt of alkylarylsulfonate, and 40 parts mineral oil having a boiling range between 510° F. and 620° F. (about 266° C. and 327° C.) (see U.S. Pat. Nos. 4,103,068 and 4,105,568 to Marshall et al., hereby incorporated by reference). About 0.5 weight percent of the finish composition was applied to the yarn based on the weight of the yarn. The ends were then transported via interfloor tube and aspirator 20 to the spin draw panel 21 where they were fed to wrap around a pretension roll 23 and accompanying separator roll **23*a* and then to feed roll 24 and accompanying separator roll 24*a* rotating at a speed of about 456 meters per minute. Both sets of rolls were at a temperature of less than 50° C., and the tension between pretension 23 and feed 24 rolls was about 0.03 gram per denier. From feed roll 24, the ends were then passed through conventional steam impinging draw point localizing jet 25, supplying steam at a temperature of 290° C. and at a pressure of 100 psig (7.03 kg per cm$^2$), and then to a pair of draw rolls 26 and 26*a*, rotating at 2,645 meters per minute. Draw roll 26*a* was maintained at about 130° C. to 140° C. The draw ratio was about 5.80 to 1. Yarn tension was maintained at about 0.4 gram per denier as the ends passed from draw roll 26 to relax roll 27 and accompanying separator roll 27*a*, the relax roll 27 being heated to 140° C. and rotating at 2,592 meters per minute. The yarn ends then passed through a conventional air operated interlacing jet 28 and were taken up by a winder 22** at a tension of from about 0.10 to 0.13 gram per denier. Table I below sets forth the physical properties and quality of the yarn so produced.

EXAMPLES 2–8 yarn was produced in accordance with the process of Example 1, varying only the temperature of steam in the draw point localizing jet 25 for each of Examples 2–8. Physical properties and quality of the yarn so produced are set forth in Table I.

With reference to Table I, it can be seen that increased draw point localizing jet steam temperatures resulted in reduced yarn thermal shrinkage and improved yarn dimensional stability with no adverse yarn property changes, such as lowered strength or increased elongation. This is unexpected, as a reduction in polyester yarn thermal shrinkage according to other processes normally can be achieved only by sacrificing strength or mechanical quality, by increasing the ultimate elongation or elongation at break, or by the expensive alternative of a separate operation following drawing, such as annealing.

TABLE I

| | Yarn Physicals | | | | | | | | Yarn Quality | |
|---|---|---|---|---|---|---|---|---|---|---|
| Example | DPL Steam Temp. (°C.) | Denier | U.T.S. (g/denier) | U.E. (%) | T.S. (%) | U.E. + T.S. (%) | Toughness | Modulus (g/denier) | Strobe | Mechanical |
| 1 | 290 | 1021 | 8.89 | 13.6 | 10.9 | 24.5 | 1.38 | 73.9 | 2.5 | 2.0 |
| 2 | 320 | 1025 | 9.00 | 13.4 | 10.8 | 24.2 | 1.38 | 75.8 | 2.0 | 1.25 |
| 3 | 361 | 1017 | 9.12 | 13.2 | 10.4 | 23.6 | 1.38 | 73.6 | 1.5 | 1.0 |
| 4 | 402 | 1006 | 9.15 | 12.8 | 9.5 | 22.3 | 1.35 | 78.4 | 1.0 | 1.0 |
| 5 | 440 | 1006 | 9.16 | 12.7 | 8.6 | 21.3 | 1.38 | 75.7 | 1.0 | 1.15 |
| 6 | 482 | 1009 | 9.13 | 13.2 | 7.6 | 20.8 | 1.43 | 74.4 | 1.0 | 1.0 |
| 7 | 520 | 1004 | 9.05 | 13.2 | 6.7 | 19.9 | 1.43 | 74.3 | 1.0 | 1.0 |
| 8 | 548 | 997 | 9.15 | 12.8 | 6.9 | 19.7 | 1.42 | 81.0 | 1.0 | 1.0 |

Further, the 290° C. temperature of Example 1 was set as the lower limit for evaluation as the yarn kept breaking out and could not be strung up at draw point localizing steam temperatures below 290° C. It can be seen that % U.E. + % T.S. dropped at every draw point localizing steam temperature increase; there appears to be approximately an inverse straight line relationship such that each 10° C. rise in draw point localizing steam temperature results in about an 0.18 to 0.20 percent reduction in % U.E.+% T.S. The % T.S. is clearly reduced at each increase in draw point localizing steam temperature and shows an inverse straight line relationship with draw point localizing steam temperature between 360° C. and 520° C. where each 10° C. rise in draw point localizing steam temperature causes a 0.23 percent reduction in % T.S.

As draw point localizing steam temperature was increased, denier was slowly reduced, which indicates that less relaxing and shrinkage was occurring on the relax rolls. This would normally be expected to increase % T.S.; however, % T.S. was decreased, possibly indicating that the yarn was partially annealed at these high temperatures or the crystallinity as increased.

EXAMPLE 9

Yarn was produced in accordance with the process of Example 1 with the following variations. The melt was supplied at a temperature of about 282° C. Heated sleeve 16 was maintained at a temperature of about 300° C. Draw point localizing jet 25 was supplied with steam at a temperature of about 550° C. and at a pressure of 110 psig (7.73 kg per cm$^2$). Draw roll 26*a* was maintained at a temperature of about 230° C., and relax roll 27 was maintained at a temperature of about 120° C. The tension between pretension 23 and feed 24 rolls was increased to 500 grams (0.08 gram per denier). Yarn tension was increased to about 1.0 gram per denier as the ends passed to relax roll 27, and winder 22 tension was increased to about 0.2 gram per denier. The draw ratio was approximately 5.9. Table II below sets forth the physical properties and quality of the yarn so produced.

TABLE II

| Example | Yarn Physicals | | | | | Yarn Quality | |
|---|---|---|---|---|---|---|---|
| | Denier | U.T.S. (g/denier) | U.E. (%) | T.S. (%) | U.E. + T.S. (%) | Strobe | Mechanical |
| 9 | 1016 | 9.23 | 11.0 | 7.6 | 18.6 | 1.0 | 1.0 |

With reference to Examples 8 and 9, it can be seen that whereas increased draw point localizing steam temperatures reduces % U.E.+T.S. primarily through a % T.S. reduction, the other parameters (variations of Example 9) reduce % U.E.+% T.S. principally by reducing % U.E.

EXAMPLE 10

Yarn was produced in accordance with the process of Example 1 with the following variations. The melt had an intrinsic viscosity of about 0.68 to 0.78 and was supplied at a temperature of about 283° C. Draw point localizing jet 25 supplied steam at a temperature of about 425° C. to 430° C. Table III below sets forth the physical properties of yarn so produced.

EXAMPLE 11

Yarn was produced in accordance with the process of Example 1 with the following variations. The melt had an intrinsic viscosity of about 0.68 to 0.78 and was supplied at a temperature of about 275° C. Heated sleeve 16 was maintained at a temperature of about 250° C. Draw point localizing jet 25 was supplied with steam at a temperature of about 550° C. and at a pressure of 110 psig (7.73 kg per cm$^2$). The draw ratio was 6.2 to 1. Draw roll 26*a* was maintained at a temperature of about 225° C. to 230° C. Relax roll 27 was maintained at a temperature of about 115° C. while yarn tension to relax roll 27 was maintained at about 0.9 to 1.0 gram per denier. Yarn ends were taken up by winder 22 at a tension of from about 0.06 to 0.6 gram per denier, typically 0.2 gram per denier. Table III below sets forth the physical properties of the yarn so produced.

EXAMPLE 12

Yarn was produced in accordance with the process of Example 11, except that the temperature of steam in the draw point localizing jet 25 was 580° C. Physical properties of the yarn so produced are set forth in Table III below.

Note, in order to optimize process performance and product quality, the draw point localizing jet steam pressure was reduced to 100 psig (7.03 kg per cm$^2$) at 580° C. Above 580° C., yarn quality and process performance were unacceptable.

EXAMPLE 13

Yarn was produced in accordance with the process of Example 1 with the following variations. The melt had an intrinsic viscosity of 0.72 to 0.78 and was supplied at a rate of 42.5 pounds per hour (19.3 kg per hour) per end and at a temperature of about 270° C. to 280° C. The temperature of the heated sleeve was maintained at about 275° C. The tension between pretension 23 and feed 24 rolls was about 0.07 gram per denier. Feed roll 24 and accompanying separator roll 24*a* were rotating at about 495 meters per minute. Draw point localizing jet 25 was supplied with steam at a temperature of about 525° C. and at a pressure of 90±10 psig (6.3 ±0.7 kg per cm$^2$). The draw ratio was about 6.125 to 1. Draw roll 26*a* was maintained at a temperature of about 190° C. Draw rolls 26 and 26*a* were rotating at about 3025 meters per minute. Yarn tension was maintained at about 0.35 gram per denier as the ends passed from draw rolls 26 to relax roll 27 and accompanying separator roll 27*a*, the relax roll 27 being heated to about 162° C. and rotating at about 2950 meters per minute. The yarn ends were taken up by an automatic doff winder 22 at a tension of about 0.35 gram per denier. Physical properties of the yarn so produced are set forth in Table III.

EXAMPLE 14

Yarn was produced in accordance with the process of Example 13 with the following variations. The melt was supplied at a rate of about 40 pounds per hour (18.1 kg per hour) per end. Feed roll 24 and accompanying separator roll 24*a* were rotating at about 458 meters per minute. Draw point localizing jet 25 was supplied with steam at a temperature of about 534° C. The draw ratio was about 6.175 to 1. Draw roll 26*a* was maintained at a temperature of about 195° C. Draw rolls 26 and 26*a* were rotating at about 2822 meters per minute. Yarn tension was maintained at about 0.30 gram per denier as the ends passed from draw roll 26 to relax roll 27 and accompanying separator roll 27*a*, the relax roll 27 being heated to about 115° C. and rotating at about 2737 meters per minute. The yarn ends were taken up by a manual doff winder 22 at a tension of about 0.12 gram per denier. Physical properties of the yarn so produced are set forth in Table III.

A high strength dimensionally stable product is produced according to Examples 11 through 14. A major advantage of this process is the ability to produce such a product from lower intrinsic viscosity polymer which is cheaper to produce as it requires less energy than high intrinsic viscosity polymer, gives increased capacity from the same equipment, and results in lower COOH, desirable for improved thermal stability.

TABLE III

Low I.V. Yarn Physical Properties

| Example | Yarn I.V. | Yarn COOH | Denier | Break Strength (lbs.) | U.T.S. (g/denier) | U.E. (%) | T.S. (%) | U.E. + T.S. (%) |
|---|---|---|---|---|---|---|---|---|
| 10 | 0.73 | 17.0 | 995.0 | 18.3 | 8.34 | 10.5 | 11.3 | 21.8 |
| 11 | 0.73 | 16.0 | 998.0 | 20.1 | 9.15 | 10.3 | 6.5 | 16.8 |
| 12 | 0.73 | — | 996.0 | 19.6 | 8.91 | 10.1 | 6.5 | 16.6 |
| 13 | 0.74 | 14.6 | 1009.0 | 19.3 | 8.67 | 11.6 | 6.6 | 18.2 |
| 14 | 0.74 | 14.8 | 1006.0 | 19.1 | 8.61 | 11.9 | 6.7 | 18.6 |

What is claimed is:

1. A process for the simultaneous spin-drawing of one or more ends of multifilament, continuous filament, synthetic polyester fiber, comprising the steps of:
(a) supplying a melt of polyester polymer to a spinning unit;
(b) extruding the melt through a spinnerette having a plurality of extrusion orifices to form filaments;
(c) advancing the extruded filaments through a substantially stationary column of air contained in a heated sleeve having a temperature of about 200° C. to 450° C.
(d) advancing the filaments through a quenching zone;
(e) lubricating the filaments;
(f) passing the lubricated filaments over a forwarding roll system maintained at a temperature of less than 50° C.;
(g) subsequently passing the filaments through a steam impinging draw point localizing jet at a steam temperature of about 482° C. to 580° C. to heat the filaments substantially immediately above their second order transition temperature;
(h) passing the filaments over a pair of draw rolls wherein at least one of the draw rolls is maintained at a temperature between about 170° C. and 237° C.;
(i) passing the filaments over a relax roll system maintained at a temperature between about 60° C. to 230° C., yarn tension to the relax roll system being maintained at about 0.2 to 2.0 grams per denier; and
(j) winding up the filaments at a tension of from about 0.06 to 1.0 gram per denier; whereby a reduced shrinkage, dimensionally stable fiber is produced.

2. The process of claim 1 wherein the melt of polyester polymer is supplied at a rate of about 15 to 120 pounds per hour per end and at a temperature of about 272° C. to 320° C.

3. The process of claim 2 wherein the melt of polyester polymer is supplied at a rate of about 35 to 75 pounds per hour per end and at a temperature of about 272° C. to 310° C.

4. The process of claim 2 wherein the melt of polyester polymer has an intrinsic viscosity of about 0.60 to 0.96.

5. The process of claim 4 wherein the melt of polyester polymer has an intrinsic viscosity of about 0.68 to 0.78.

6. The process of claim 1 wherein during the step of advancing the extruded filaments through a substantially stationary column of air, the heated sleeve has a temperature of about 200° C. to 350° C.

7. The process of claim 6 wherein the heated sleeve has a temperature of about 270° C. to 280° C.

8. The process of claim 1 wherein the step of passing the filaments through a steam impinging draw point localizing jet occurs at a steam temperature of about 510° C. to 580° C.

9. The process of claim 8 wherein the step of passing the filaments through a steam impinging draw point localizing jet occurs at a steam temperature of about 550° C.

10. The process of claim 1 wherein the polyester is polyethylene terephthalate.

11. The process of claim 1 wherein during the step of passing the filaments over a pair of draw rolls, at least one of the draw rolls is maintained at a temperature between about 190° C. and 237° C.

12. The process of claim 11 wherein during the step of passing the filaments over a pair of draw rolls, both draw rolls are maintained at a temperature of from about 190° C. to 237° C.

13. The process of claim 12 wherein both draw rolls are maintained at a temperature of about 225° C. to 230° C.

14. The process of claim 12 wherein both draw rolls are maintained at a temperature of about 190° C. to 200° C.

15. The process of claim 1 wherein during the step of passing the filaments over a pair of draw rolls one of the draw rolls is maintained at a temperature of about 225° C. to 230° C. and the other draw roll is not heated.

16. The process of claim 1 wherein the relax roll system is maintained at a temperature of about 60° C. to 175° C.

17. The process of claim 1 wherein the filaments are wound up at a tension of from about 0.06 to 0.6 gram per denier.

18. The process of claim 1 wherein the filaments are wound up at a tension of from about 0.1 to 1.0 gram per denier.

* * * * *